US011104133B2

(12) United States Patent
Yamamoto

(10) Patent No.: US 11,104,133 B2
(45) Date of Patent: Aug. 31, 2021

(54) LIQUID DISCHARGING HEAD

(71) Applicant: Brother Kogyo Kabushiki Kaisha, Nagoya (JP)

(72) Inventor: Jiro Yamamoto, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 15 days.

(21) Appl. No.: 16/832,189

(22) Filed: Mar. 27, 2020

(65) Prior Publication Data

US 2020/0307195 A1 Oct. 1, 2020

(30) Foreign Application Priority Data

Apr. 1, 2019 (JP) ..... JP2019-069583

(51) Int. Cl.
*B41J 2/14* (2006.01)
*B41J 2/175* (2006.01)

(52) U.S. Cl.
CPC ..... *B41J 2/1433* (2013.01); *B41J 2/17596* (2013.01); *B41J 2002/14459* (2013.01)

(58) Field of Classification Search
CPC .. B41J 2/1433; B41J 2/17596; B41J 2/14201; B41J 2002/14419; B41J 2002/14459
USPC ..... 347/20, 54, 68, 84, 85
See application file for complete search history.

(56) References Cited

U.S. PATENT DOCUMENTS 8,870,353 B2 * 10/2014 Watanabe ..... B41J 2/14274 347/70
10,022,967 B2 * 7/2018 Mizuno ..... B41J 2/04505
10,549,539 B2 * 2/2020 Katayama ..... B41J 2/14209

FOREIGN PATENT DOCUMENTS

JP 2015-101034 A 6/2015

* cited by examiner

*Primary Examiner* — An H Do
(74) *Attorney, Agent, or Firm* — Banner & Witcoff, Ltd.

(57) ABSTRACT

A liquid discharging head, having a first pressure chamber group, a second pressure chamber group, and a common flow path, is provided. The first pressure chamber group and the second pressure chamber group each have a plurality of pressure chambers arrayed in a first direction. The second pressure chamber group aligns with the first pressure chamber group along a second direction intersecting with the first direction. The common flow path extends in the first direction. The common flow path communicates with each of the pressure chambers belonging to the first pressure chamber group and the second pressure chamber group. The common flow path has a supplying opening at one end thereof and a returning opening at the other end thereof in the first direction. The common flow path is located between the first pressure chamber group and the second pressure chamber group in the second direction.

14 Claims, 7 Drawing Sheets

LIQUID DISCHARGING HEAD

CROSS REFERENCE TO RELATED APPLICATION

This application claims priority from Japanese Patent Application No. 2019-069583, filed on Apr. 1, 2019, the entire subject matters of which are incorporated herein by reference.

BACKGROUND

Technical Field

An aspect of the present disclosure is related to a liquid discharging head having two (2) groups of pressure chambers and a common flow path for the groups of the pressure chambers.

Related Art

A liquid discharging head having two (2) pressure chamber groups, each of which includes a plurality of pressure generating chambers ("pressure chambers"), aligning side by side along a first direction X, and two (2) manifolds being common flow paths provided commonly to the two groups of the pressure chambers is known. The manifolds may communicate with an inflow path at ends thereof on one side in the first direction X and with an outflow path at ends thereof on the other side in the first direction X.

SUMMARY

Liquid may enter the manifolds through the inflow path and exit through the outflow path to circulate within the manifolds so that air bubbles in the liquid may be removed and the liquid may be prevented from being thickened during the circulation. In this regard, however, as one and the other of the manifolds may be arranged on one side and the other side of the two groups of the pressure chambers in a second direction Y, respectively, a dimension of the liquid discharging head in the second direction Y may tend to increase.

The present disclosure is advantageous in that a liquid discharging head, which may be restrained from expanding in the second direction while liquid may circulate in a common flow path, is provided.

According to an aspect of the present disclosure, a liquid discharging head, comprising a first pressure chamber group, a second pressure chamber group, and a common flow path, is provided. The first pressure chamber group has a plurality of pressure chambers arrayed in a first direction. The second pressure chamber group has a plurality of pressure chambers arrayed in the first direction. The second pressure chamber group aligns with the first pressure chamber group along a second direction intersecting with the first direction. The common flow path extends in the first direction. The common flow path communicates with each of the plurality of pressure chambers belonging to the first pressure chamber group and the plurality of pressure chambers belonging to the second pressure chamber group. The common flow path has a supplying opening at one end thereof in the first direction and a returning opening at the other end thereof in the first direction. The common flow path is located between the first pressure chamber group and the second pressure chamber group in the second direction.

BRIEF DESCRIPTION OF THE ACCOMPANYING DRAWINGS

DETAILED DESCRIPTION

First Embodiment

Figure 1:
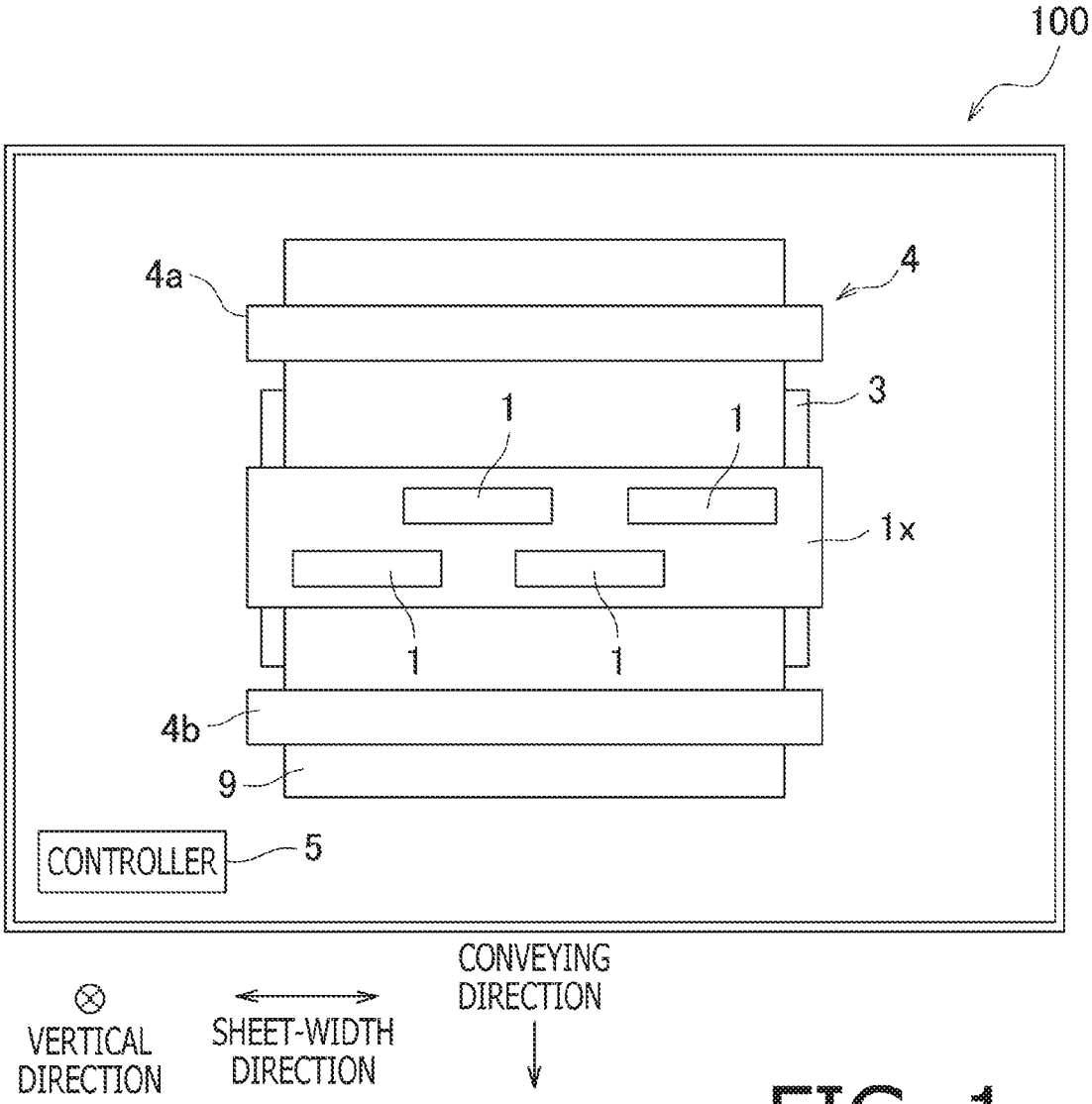
FIG. 1 is a plan view of a printer 100 having heads 1 according to a first embodiment of the present disclosure.

With reference to FIG. 1, described in the following paragraphs will be an overall configuration of the printer 100 having the heads 1 according to the embodiment of the present disclosure.

The printer 100 includes a head unit 1*x*, a platen 3, a conveyer 4, and a controller 5. The head unit 1*x* may include four (4) heads 1.

A sheet 9 may be set on top of an upper surface of the platen 3.

Figure 5:
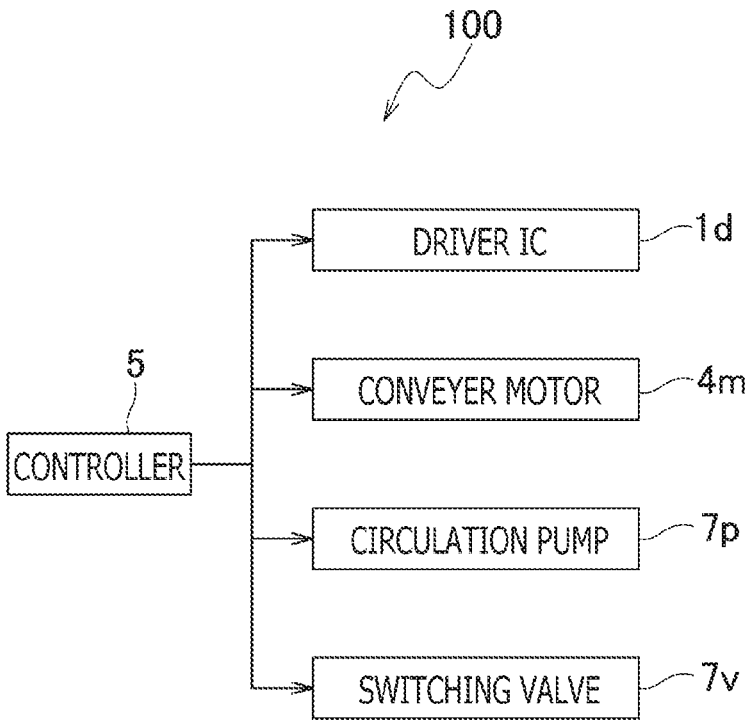
FIG. 5 is a block diagram to illustrate an electrical configuration of the printer 100 according to the first embodiment of the present disclosure.

The conveyer 4 includes two (2) roller pairs 4*a*, 4*b*, which are arranged on one side and the other side of the platen 3 in a conveying direction. As a conveyer motor 4*m* (see FIG. 5) operates under control of the controller 5, the roller pairs 4*a*, 4*b* may rotate so that the sheet 9 nipped between rollers in at least one of the roller pairs 4*a*, 4*b* may be conveyed in the conveying direction.

The head unit 1*x* is a line-printing inkjet head extending longitudinally in a sheet-width direction, which is orthogonal to the conveying direction and to a vertical direction. The head unit 1*x* may discharge ink at the sheet 9 through nozzles 21 (see FIGS. 2 and 3) while being situated at a fixed position. The heads 1 in the head unit 1*x*, each extending longitudinally in the sheet-width direction, are arranged alternately in zigzag along the sheet-width direction.

The controller 5 includes a Read Only Memory (ROM), a Random Access Memory (RAM), and an Application Specific Integrated Circuit (ASIC). The ASIC may execute processes including a recording process in accordance with programs that are stored in the ROM. In the recording process, the controller 5 may control a driver IC 1*d* (see FIG. 5) and the conveyer motor 4*m* for each head 1 to record an image on the sheet 9.

Next, with reference to FIGS. 2-4, described below will be a representing one of the heads 1.

Figure 3:
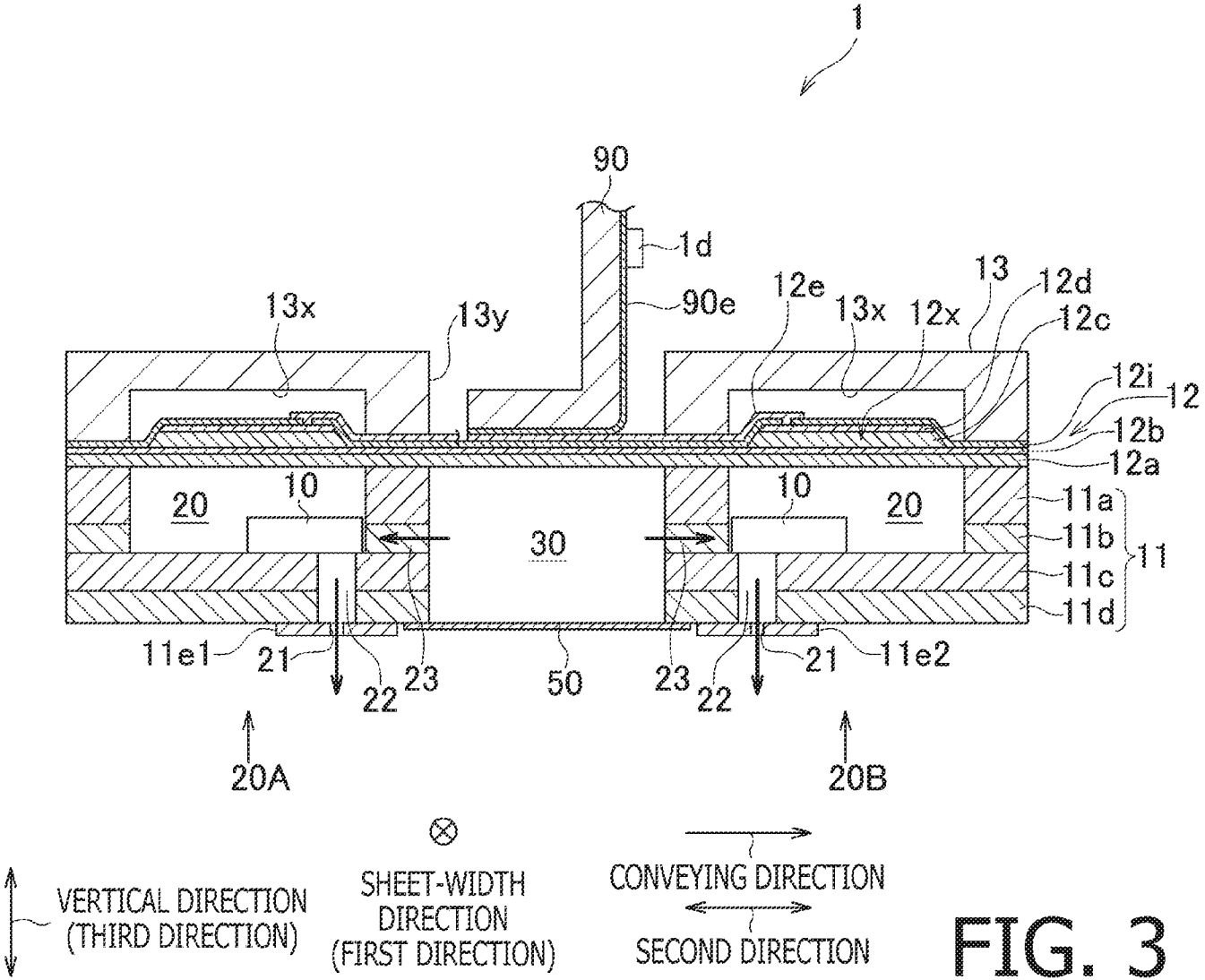
FIG. 3 is a cross-sectional view of the head 1 according to the first embodiment of the present disclosure viewed along a line III-III shown in FIG. 2.

The head 1 includes, as shown in FIG. 3, a flow path board 11, an actuator board 12, a protector board 13, and a wiring board 90.

The flow path board 11 is formed to have a plurality of pressure chambers 20, a plurality of nozzles 21, a plurality of connecting flow paths 22, a plurality of linking flow paths 23, and a common flow path 30.

The flow path board 11 includes four (4) plates 11*a*-11*d*, which are layered in the vertical direction, and two (2) nozzle plates 11*e*1, 11*e*2, which are attached to a downward face of a lower most plate 11*d* among the plates 11*a*-11*d*.

The plurality of pressure chambers 20 are formed of a plurality of holes, which are formed through the plates 11*a*, 11*b*, and are open upward on an upper face of the flow path board 11.

Figure 2:
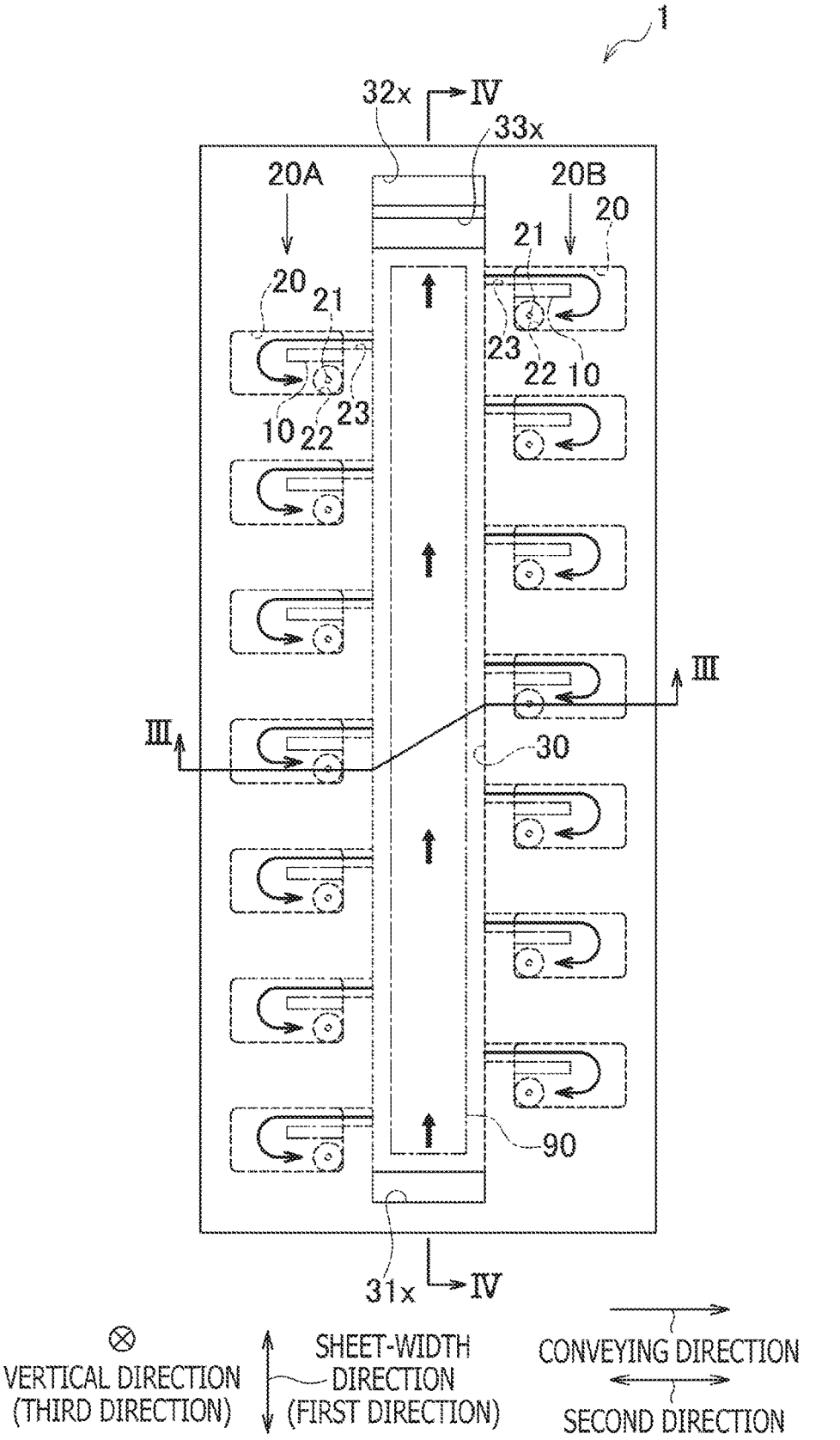
FIG. 2 is a plan view of one of the heads 1 according to the first embodiment of the present disclosure.

The plurality of pressure chambers 20 are, as shown in FIG. 2, arranged alternately in zigzag along a first direction being the sheet-width direction and form a first pressure chamber group 20A and a second pressure chamber group 20B. The first pressure chamber group 20A and the second pressure chamber group 20B, each including a plurality of pressure chambers 20 that are arrayed in line in the first direction to be evenly spaced apart from one another, align with each other side by side along a direction parallel to the conveying direction. Each of the pressure chambers 20 is formed substantially in a rectangular shape, extending longer in the second direction, on a plane that intersects with a third direction being the vertical direction. The third direction is orthogonal to the first direction and to the second direction.

The connecting flow paths 22 are each provided to each one of the pressure chambers 20. In other words, the connecting flow paths 22 and the pressure chambers 20 are in one-to-one correspondence with the pressure chambers 20. As shown in FIG. 3, each connecting flow path 22 extends downward from one end of the corresponding pressure chamber 20 in the second direction, e.g., from an end closer to the common flow path 30 in the second direction, to connect the pressure chamber 20 with one of the nozzles 21. In other words, each connecting flow path 22 is adjacent to the end of the corresponding pressure chamber 20 closer to the common flow path 30 in the second direction. The connecting flow paths 22 are formed of a plurality of through holes, which are formed through the plates 11*c*, 11*d*.

The nozzles 21 are each provided to each one of the pressure chambers 20. In other words, the nozzles 21 and the pressure chambers 20 are in one-to-one correspondence. As shown in FIG. 3, each nozzle 21 is located at a position directly below the connecting flow path 22 and is open downward from a downward face of the flow path board 11. The nozzle 21 and the corresponding pressure chamber 20 communicate through the connecting flow path 22.

The nozzles 21 communicating with the pressure chambers 20 belonging to the first pressure chamber group 20A are formed in the nozzle plate 11*e*1 and the nozzles 21 communicating with the pressure chambers 20 belonging to the second pressure chamber group 20B are formed in the nozzle plate 11*e*2. The nozzle plates 11*e*1, 11*e*2 may be separately formed substantially rectangular plates longitudinally extending in the first direction.

The linking flow paths 23 are each provided to each one of the pressure chambers 20. In other words, the linking flow paths 23 and the pressure chambers 20 are in one-to-one correspondence. As shown in FIG. 3, each linking flow path 23 extends in the second direction from one end of the corresponding pressure chamber 20, e.g., from an end closer to the common flow path 30 in the second direction, to the common flow path 30 to connect the pressure chamber 20 with the common flow path 30. In other words, each linking flow path 23 is adjacent to the end of the corresponding pressure chamber 20 closer to the common flow path 30 in the second direction. The linking flow paths 23 are formed of a plurality of through holes, which are formed through the plate 11*b*. The linking flow paths 23 are arranged in a range of the pressure chambers 20 in the third direction. In other words, the linking flow paths 23 are arranged within a height range of the pressure chambers 20.

Each linking flow path 23 is, as shown in FIG. 3, connected to a lower end of the corresponding pressure chamber 20.

Moreover, each linking flow path 23 is, as shown in FIG. 2, connected to one end of the corresponding pressure chamber 20 in the first direction. Meanwhile, each of the connecting flow paths 22 is connected to the other end of the corresponding pressure chamber 20 in the first direction. The linking flow path 23 and the connecting flow path 22 that correspond to the same pressure chamber 20 are located at positions different from each other in the first direction and in proximity, or adjacent, to each other in the second direction. In other words, the linking flow path 23 and the connecting flow path 22 that correspond to the same pressure chamber 20 may be located adjacent to each other across a border of the pressure chamber 20 that is closer to the common flow path 30 in the second direction.

In each pressure chamber 20, arranged is a partition wall 10 at a position between the linking flow path 23 and the connecting flow path 22 in the first direction. The partition wall 10 extends in the second direction from the one end, e.g., the end closer to the common flow path 30 in the second direction, approximately to a center of the pressure chamber 20 in the second direction. The partition wall 10 extends upward from an upper face of the plate 11*c* approximately to a center of the pressure chamber 20 in the third direction, as shown in FIG. 3.

The common flow path 30 is provided commonly to the first pressure chamber group 20A and the second pressure chamber group 20B. As shown in FIGS. 2 and 3, the common flow path 30 longitudinally extends in the first direction at a position between first pressure chamber group 20A and the second pressure chamber group 20B in the second direction. The common flow path 30 communicates with the plurality of pressure chambers 20 belonging to the first pressure chamber group 20A and the plurality of pressure chambers 20 belonging to the second pressure chamber group 20B through the linking flow paths 23.

As shown in FIG. 3, on a side of the first pressure chamber group 20A opposite to the common flow path 30 in the second direction, ends of the pressure chambers 20 are closed by the plates 11*a*, 11*b*, and unlike the other side of the first pressure chamber group 20A closer to the common flow path 30 in the second direction, no flow path is provided. Moreover, on a side of the second pressure chamber group 20B opposite to the common flow path 30 in the second direction, ends of the pressure chambers 20 are closed by the plates 11*a*, 11*b*, and unlike the other side of the second pressure chamber group 20B closer to the common flow path 30 in the second direction, no flow path is provided.

Figure 4:
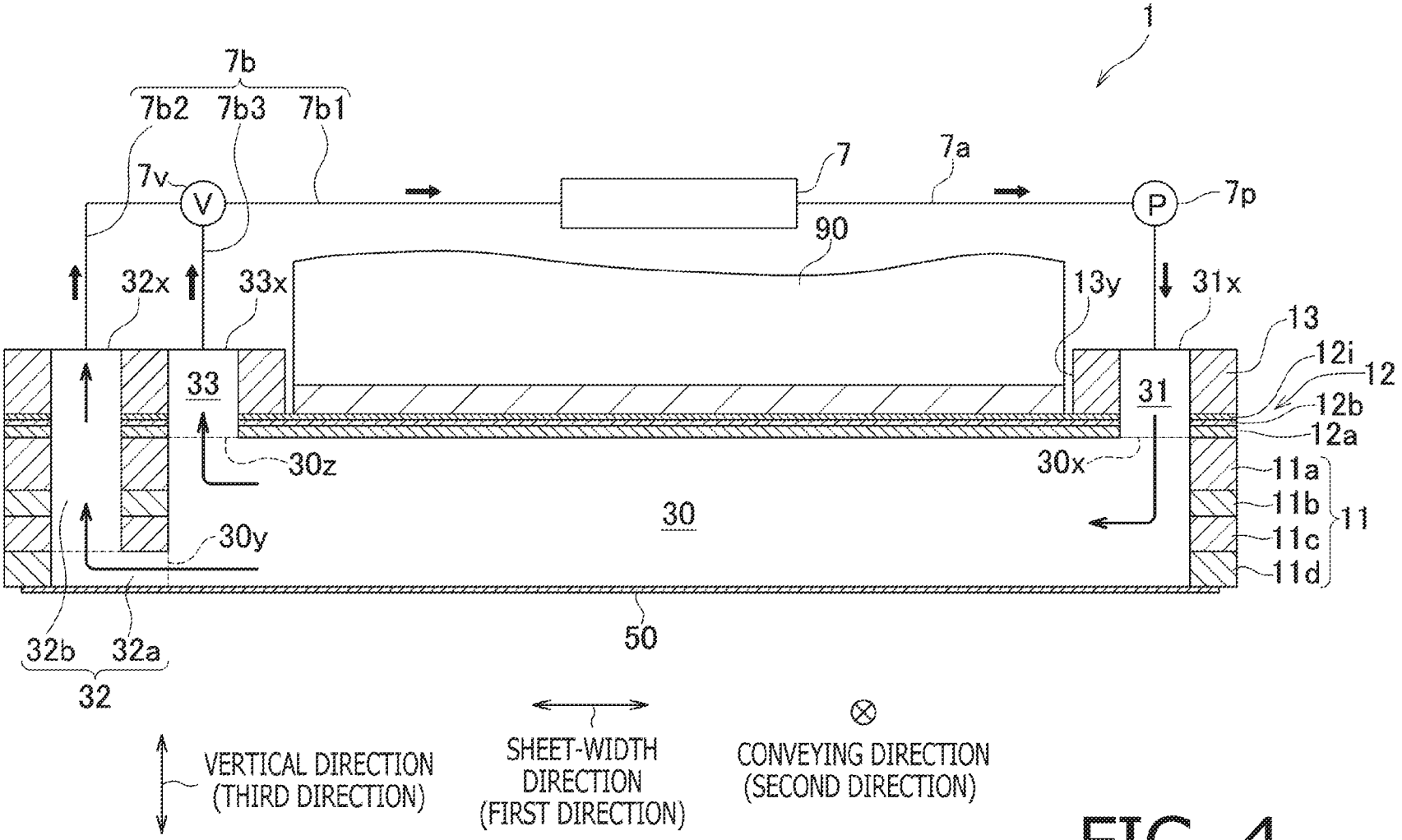
FIG. 4 is a cross-sectional view of the head 1 according to the first embodiment of the present disclosure viewed along a line IV-IV shown in FIG. 2.

The common flow path 30 is, as shown in FIGS. 3 and 4, formed of through holes formed in the plates 11*a*-11*d*.

A lower face, or a bottom, of the common flow path 30 is defined by a damper sheet 50. The damper sheet 50 is placed to close the through hole in the plate 11*d* that form a part of the common flow path 30 and adhered to a downward face of the plate 11*d*. The damper sheet 50 is, as shown in FIG. 3, located between the nozzle plate 11*e*1 and the nozzle plate 11*e*2 in the second direction.

As shown in FIG. 4, at a position on one end of the common flow path 30 in the first direction, arranged is a supply opening 30*x*, and at positions on the other end of the common flow path 30 in the first direction, arranged are a returning opening 30*y* and an air-outlet opening 30*z*. The supplying opening 30*x* and the air-outlet opening 30*z* are arranged at upper ends, e.g., on an upward face, of the common flow path 30. The returning opening 30*y* is arranged at a lower end, e.g., at a lower end of a lateral face, of the common flow path 30.

The face of the common flow path 30, e.g., a downward face, defined by the damper sheet 50 differs from a face of the common flow path 30, e.g., the upward face, on which the supplying opening 30*x* and the air-outlet opening 30*z* are formed, and from a face of the common flow path 30, e.g., the lateral face, on which the returning opening 30*y* is formed.

The actuator board 12 is fixed to the upper face of the flow path board 11 and includes a vibration board 12*a*, a common electrode 12*b*, a plurality of piezoelectric devices 12*c*, and a plurality of individual electrodes 12*d*.

The vibration board 12*a* and the common electrode 12*b* are arranged substantially entirely over the upper face of the flow path board 11, i.e., an upper face of the plate 11*a*, to cover all of the pressure chambers 20 formed in the flow path board 11. Meanwhile, the piezoelectric devices 12*c* and the individual electrodes 12*d* are each provided to each one of the pressure chambers 20. In other words, the piezoelectric devices 12*c*, the individual electrodes 12*d*, and the pressure chambers 20 are in one-to-one correspondence mutually. The piezoelectric devices 12*c* and the individual electrodes 12*d* are arranged to overlap the corresponding pressure chambers 20 in the third direction.

The actuator board 12 further includes an insulation sheet 12*i* and a plurality of individual wires 12*e*.

The insulation sheet 12*i* may be made of, for example, silicon dioxide ($SiO_2$) and covers a part of an upper face of the common electrode 12*d* where no piezoelectric device 12*c* is arranged, sideward faces of the piezoelectric devices 12*c*, and upper faces of the individual electrodes 12*d*. Through holes are formed in the insulation sheet 12*i* at positions coincident with the individual electrodes 12*d* in the vertical direction.

The individual wires 12*e* are arranged on the insulation sheet 12*i* with downward ends thereof being inserted in the through holes formed in the insulation sheet 12*i* so that the downward ends of the individual wires 12*e* contact the corresponding individual electrodes 12*d*. Thus, the individual wires 12*e* are each electrically connected with one of the individual electrodes 12*d*. The individual wires 12*e* extend in the second direction to a center of the actuator board 12 in the second direction.

To an upper face of the actuator board 12, at a position coincident with the center of the actuator board 12 in the second direction, fixed is one end of the wiring board 90. The other end of the wiring board 90 is connected to the controller 5. Between the one end and the other end of the wiring board 90, mounted is the driver IC 1*d*.

The wiring board 90 may include, for example, Chip On Film (COF) and extends in the first direction on the upper face of the actuator board 12 (see FIG. 2). The wiring board 90 includes a plurality of individual wires 90*e* (see FIG. 3), which are each electrically connected with each one of the individual wires 12*e*, and a common wire (not shown). The common wire is electrically connected with the common electrode 12*b* through a through hole formed in the insulation sheet 12*i*.

The driver IC 1*d* is electrically connected with each of the individual electrodes 12*d* through the individual wires 90*e* and with the common electrode 12*b* through the common wire. The driver IC 1*d* may maintain potential in the common electrode 12*b* at a ground potential and, on the other hand, change potentials in the individual electrodes 12*d*. In particular, the driver IC 1*d* may generate driving signals based on controlling signals from the controller 5 and apply the generated driving signals to the individual electrodes 12*d* individually. Thereby, the potentials in the individual electrodes 12*d* may individually change between a predetermined driving potential and the ground potential. As the potential in the individual electrode 12*d* changes, a part of the vibration board 12*a* and the piezoelectric device 12*c* interposed between the individual electrode 12*d* having the changed potential and the pressure chamber 20, i.e., the actuator 12*x*, may deform to dent into the pressure chamber 20, and a capacity of the pressure chamber 20 changes so that the ink in the pressure chamber 20 may be pressurized and discharged through the nozzle 21.

As the ink is discharged through the nozzles 21, ink to refill the pressure chambers 20 may be supplied to the pressure chambers 20 through the linking flow paths 23. In particular, as shown in FIGS. 2 and 3, the ink may be conveyed in the second direction from the common flow path 30 through the linking flow paths 23 and flow in the pressure chambers 20 through the ends of the pressure chambers 20 on the one side in the first direction and the one side closer to the common flow path 30 in the second direction. The ink may, as shown in FIG. 2, flow from the one end to the other end of the pressure chamber 20 in the second direction, e.g., outward, along the partition wall 10. Thereafter, the ink may make a U-turn at the other end of the pressure chamber 20 in the second direction to reach the other end of the pressure chamber 20 in the first direction, on the one end closer to the common flow path 30 in the second direction, and flow downward through the connecting flow path 22 to be discharged through the nozzle 21.

The protector board 13 is adhered to an upper face of the insulation sheet 12*i* and includes, as shown in FIGS. 3 and 4, two (2) raised portions 13*x* and a through hole 13*y*.

The raised portions 13*x* are formed on a downward side of the protector board 13 and extend longitudinally in the first direction. One of the raised portions 13*x* overlaps the pressure chambers 20 belonging to the first pressure chamber group 20A in the third direction, and the other of the raised portions 13*x* overlaps the pressure chambers 20 belonging to the second pressure chamber group 20B in the third direction. In the one and the other of the raised portions 13*x*, the actuators 12*x* corresponding to the first and second pressure chamber groups 20A, 20B are accommodated, respectively.

The through hole 13*y* extends in the first direction at a center of the protector board 13 in the second direction and is formed through the protector board 13 in the third direction. In the through hole 13*y*, a part of the wiring board 90 on the one end is arranged.

The head 1 further includes, as shown in FIG. 4, a supplying path 31 connected to the supplying opening 30*x*, a returning path 32 connected to the returning opening 30*y*, and an air-outlet path 33 connected to the air-outlet opening 30*z*.

The supplying path 31 extends upward from the supplying opening 30*x*. An upper end of the supplying path 31 forms an opening 31*x*.

The returning path 32 includes a first part 32*a*, which extends in the first direction from the returning opening 30*y*, and a second part 32*b*, which extends upward from an end of the first part 32*a*. An upper end of the second part 32*b* forms an opening 32*x*.

The air-outlet path 33 extend upward from the air-outlet opening 30*z*. An upper end of the air-outlet path 33 forms an opening 33*x*.

The supplying path 31 and the air-outlet path 33 are each formed of through holes formed in the protector board 13 and the actuator board 12. With regard to the returning path 32, the first part 32*a* is formed of a through hole formed in the plate 11*d*, and the second part 32*b* is formed of through holes formed in the protector board 13, the actuator board 12, and the plates 11*a*-11*c*.

As shown in FIGS. 2 and 4, the opening 31*x* is located on one end of the head 1 in the first direction, and the openings 32*x*, 33*x* are located on the other end of the head 1 in the first direction. The opening 33*x* is located between the opening 31*x* and the opening 32*x* in the first direction. Meanwhile, at a position between the opening 31*x* and the opening 33*x* in the first direction, arranged is the one end of the wiring board 90. In other words, the opening 31*x* is arranged on one side of the wiring board 90 in the first direction, and the openings 32*x*, 33*x* are arranged on the other side of the wiring board 90 in the first direction. The openings 31*x*-33*x* and the one end of the wiring board 90 align in the first direction at a center of the head 1 in the second direction.

The openings 31*x*-33*x* communicate with a subsidiary tank 7, as shown in FIG. 4. The subsidiary tank 7 communicates with a main tank, which is not shown, and stores ink supplied from the main tank.

The opening 31*x* is connected with the subsidiary tank 7 through a path 7*a*. In the path 7*a*, arranged is a circulation pump 7*p*.

The openings 32*x*, 33*x* are connected with the subsidiary tank 7 through a path 7*b*. In the path 7*b*, arranged is a switching valve 7*v*. The path 7*b* includes a first path 7*b*1, a second path 7*b*2, and a third path 7*b*3, each extending to or from the switching valve 7*v*. The first path 7*b*1 has one end, at which the first path 7*b*1 is connected with the subsidiary tank 7, and the other end, at which the first path 7*b*1 is connected with the switching valve 7*v*. The second path 7*b*2 has one end, at which the second path 7*b*2 is connected with the switching valve 7*v*, and the other end, at which the second path 7*b*2 is connected with the opening 32*x*. The third path 7*b*3 has one end, at which the third path 7*b*3 is connected with the switching valve 7*v*, and the other end, at which the third path 7*b*3 is connected with the opening 33*x*.

The switching valve 7*v* may include, for example, an electromagnetic valve, and is switchable under the control of the controller 5 between a returning position, at which the opening 32*x* and the subsidiary tank 7 communicate, and an air-outlet position, at which the opening 33*x* and the subsidiary tank 7 communicate. In other words, paths for the ink may be switched by the switching valve 7*v* between a path to flow through the returning opening 30*y* and the opening 32*x* and a path to flow through the air-outlet opening 30*z* and the opening 33*x*.

The ink in the subsidiary tank 7 may be conveyed by the circulation pump 7*p* being operated under the control of the controller 5 to flow into the supplying path 31 through the opening 31*x*. The ink entering the supplying path 31 may flow downward and flow in the common flow path 30 through the supplying opening 30*x* at the one end of the common flow path 30 in the first direction. The ink entering the common flow path 30 from the one end of the common flow path 30 in the first direction may flow from the one end to the other end of the common flow path 30 in the first direction.

The ink reaching the other end of the common flow path 30 in the first direction may, when the switching valve 7*v* is at the returning position, flow from the returning opening 30*y* to return to the subsidiary tank 7 through the returning path 32 and the paths 7*b*2, 7*b*1. On the other hand, when the switching valve 7*v* is at the air-outlet position, the ink reaching the other end of the common flow path 30 in the first direction may flow from the air-outlet opening 30*z* and return to the subsidiary tank 7 through the air-outlet path 33 and the paths 7*b*3, 7*b*1.

The controller 5 may, for example, during an image recording process, place the switching valve 7*b* at the returning position 7*v* and operate the circulation pump 7*p*. On the other hand, for example, shortly before the image recording process or while pausing due to an error, the controller 5 may place the switching valve 7*v* at the air-outlet position and operate the circulation pump 7*p*.

Thus, by circulating the ink between the subsidiary tank 7 and the common flow path 30, air bubbles in the common flow path 30 may be removed, and the ink may be prevented from being thickened. Moreover, if the ink contains sedimentary materials, such as pigment, such sedimentary materials may be agitated, and the ink may be restrained from sedimentation.

It may be noted that removal of air bubbles, restraint of ink thickening, and agitation of the sediment may be achieved by circulation of the ink that flows through either the returning path 32 or the air-outlet path 33. In this regard, however, while the returning opening 30*y* is located at the lower end of the common flow path 30, in the route through the returning path 32, the sediment settling in a lower area of the common flow path 30 may be agitated more effectively. Further, while the air-outlet opening 30*z* is located at the upper end of the common flow path 30, in the route through the air-outlet path 33, the air bubbles may be easily discharged from the air-outlet opening 30*z* due to the buoyancy and removed from the ink more effectively.

According to the embodiment described above, the common flow path 30 (see FIG. 4) having the supplying opening 30*x* and the returning opening 30*y* on the one end and the other end thereof in the first direction is located, not on the one and the other sides of the entire first and second pressure chamber groups 20A, 20B in the second direction, but between the first pressure chamber group 20A and the second pressure chamber group 20B in the second direction (see FIG. 2). In this arrangement, the ink may be circulated in the common flow path 30 while the dimension of the head 1 may be restrained from increasing in the second direction.

The head 1 is provided with the switching valve 7*v*, by which the paths of the ink may be switchable between the path to flow through the returning opening 30*y* and the path to flow through the air-outlet opening 30*z* (see FIG. 4). In this arrangement, an action to promote agitation of the sediment, i.e., ink circulation in the path to flow through the returning path 32, and an action to promote removal of air bubbles, i.e., ink circulation in the path to flow through the air-outlet path 33, may be selectively performed.

The head 1 is provided with the returning path 32, which extends upward and connects to the returning opening 30*y* (see FIG. 4). In this arrangement, the air bubbles in the common flow path 30 may be easily ejected through the air-outlet opening 30*z* due to the effect of buoyancy.

The supplying opening 30*x* is arranged at the upper end of the common flow path 30 (see FIG. 4). In this arrangement, entry of the air into the common flow path 30 may be prevented due to the effect of buoyancy.

The common flow path 30 is partly defined by the damper sheet 50 (see FIGS. 3 and 4). In this arrangement, vibration of the damper sheet 50 may cause the sediment to be agitated more effectively. Due to this effect, the ink may not necessarily be moved to flow in the common flow path 30 in an excessive speed in order to merely agitate the sediment.

A face of the common flow path 30 defined by the damper sheet 50, i.e., the downward face, differs from the upward face of the common flow path 30, on which the supplying opening 30*x* is arranged, and from the lateral face of the common flow path 30, on which returning opening 30*y* is arranged (see FIG. 4). If the manufacturer of the head 1 attempts to arrange the damper sheet 50 on the same face as the supplying opening 30*x* or the returning opening 30*y*, it may be difficult to set up the damper sheet 50 correctly; moreover, an area dimension of the damper sheet 50 may be reduced, and it may be difficult for the damper sheet 50 to provide an desirable attenuating effect. According to the arrangement in the embodiment described above, on the other hand, while the damper sheet 50 is arranged on the face, on which neither the supplying opening 30*x* nor the returning opening 30*y* is arranged, setting up the damper sheet 50 may be easier, and the damper sheet 50 may provide a larger area so that the desirable attenuating effect may be achieved. Moreover, according to the arrangement in the above embodiment, it may be noted that the wiring board 90 is arranged over the common flow path 30; therefore, it may be difficult to set up the damper sheet 50 from above. Meanwhile, according to the arrangement in the embodiment described above, a space on the lower side of the common flow path 30 is not limited by the wiring board 90, or the like; therefore, the damper sheet 50 may be set up easily in conjunction with setting up of the nozzle plates 11*e*1, 11*e*2 (see FIG. 3). Furthermore, with the damper sheet 50 arranged on the lower side of the common flow path 30, vibration of the damper sheet 50 may cause the sediment settling on the bottom of the common flow path 30 to be agitated effectively.

The plurality of nozzles 21, each communicating with one of the pressure chambers 20 belonging to the first pressure chamber group 20A, and the plurality of nozzles 21, each communicating with one of the pressure chambers 20 belonging to the second pressure chamber group 20B, are separately formed in the nozzle plate 11*e*1 and the nozzle plate 11*e*2, respectively (see FIG. 3). Meanwhile, the damper sheet 50 is interposed between the two (2) nozzle plates 11*e*1 and 11*e*2 in the second direction. In this arrangement, compared to an arrangement, for example, in which a single piece of nozzle plate having a shape of a rectangular frame with a through hole at a center to be covered by the damper sheet 50 is provided, an overall dimension for the total nozzle plates 11*e*1 and 11*e*2 may be reduced, and a manufacturing cost may be reduced. Moreover, if the single and larger piece of nozzle plate is employed, the plate may warp more easily to cause a dimension error. In this regard, the two (2) pieces of smaller nozzle plates 11*e*1, 11*e*2 may be restrained from warping and improve or maintain dimensional accuracy.

The linking flow paths 23 to link the pressure chambers 20 with the common flow path 30 are arranged within the range of the pressure chambers 20 in the third direction, i.e., the height range of the pressure chambers 20. In this arrangement, compared to an arrangement, for example, in which the linking flow paths 23 are arranged outside the range of the pressure chambers 20 in the third direction, e.g., the linking flow paths 23 extending in the second direction from lower lateral faces of the common flow path 30 and bending to further extend upward to be connected with either the lower or lateral faces of the pressure chambers 20, the ink may be directly conveyed to the pressure chambers, and insufficient ink supply, i.e., under-refilling phenomenon, in the pressure chambers 20 may be restrained.

The linking flow paths 23 are linked to the lower ends of the pressure chambers 20 (see FIG. 3). In this arrangement, entry of the air into the common flow path 30 may be prevented due to the effect of buoyancy.

The linking flow path 23 and the connecting flow path 22 that correspond to the same pressure chamber 20 are located at positions different from each other in the first direction and in proximity to each other in the second direction (see FIG. 2). In this arrangement, the ink flowing in the pressure chamber 20 through the end of the pressure chamber 20 on the one side in the first direction and the one side in the second direction may make a U-turn at the other end of the pressure chamber 20 in the second direction to reach the other end of the pressure chamber 20 in the first direction and on the one end in the second direction, and flow in the connecting flow path 22. Therefore, the ink may spread substantially entirely in the pressure chamber 20, and the ink may be restrained from stagnating in the pressure chamber 20.

In each pressure chamber 20, the partition wall 10 is arranged at the position between the linking flow path 23 and the connecting flow path 22 in the first direction (see FIG. 2). In this arrangement, the flow of the ink to make the U-turn may be caused more stably in the pressure chamber 20. Therefore, the ink may be restrained from stagnating in the pressure chamber 20.

The wiring board 90 is fixed to the actuator board 12, in the area overlapping the common flow path 30 in the third direction (see FIG. 3). In this arrangement, heat from the wiring board 90 may be absorbed in the ink circulating in the common flow path 30. In other words, the wiring board 90 may be cooled efficiently.

Second Embodiment

Next, with reference to FIGS. 6 and 7, described below will be a head 201 according to a second embodiment of the present disclosure.

Figure 6:
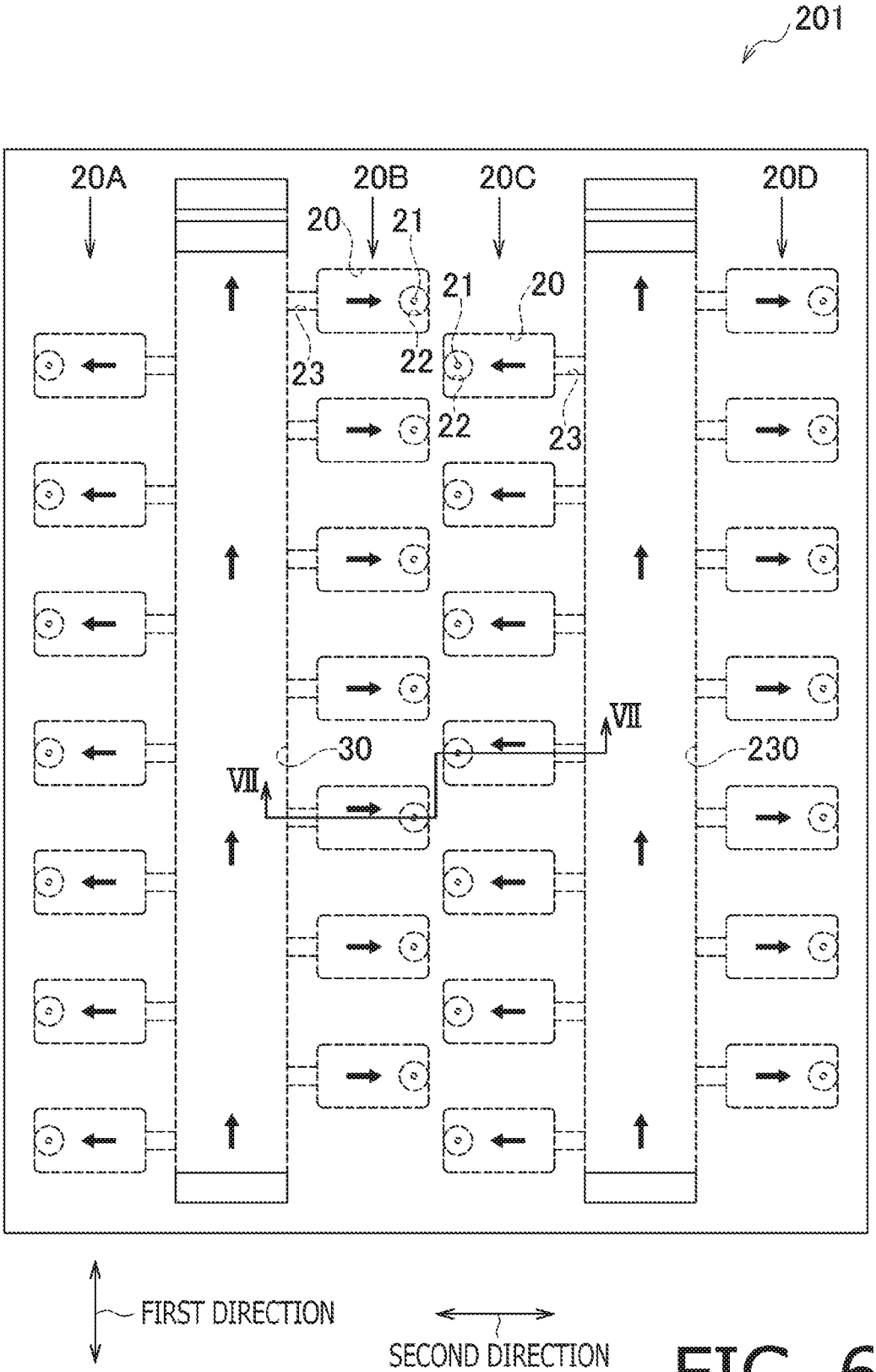
FIG. 6 is a plan view of a head 201 according to a second embodiment of the present disclosure.
Figure 7:
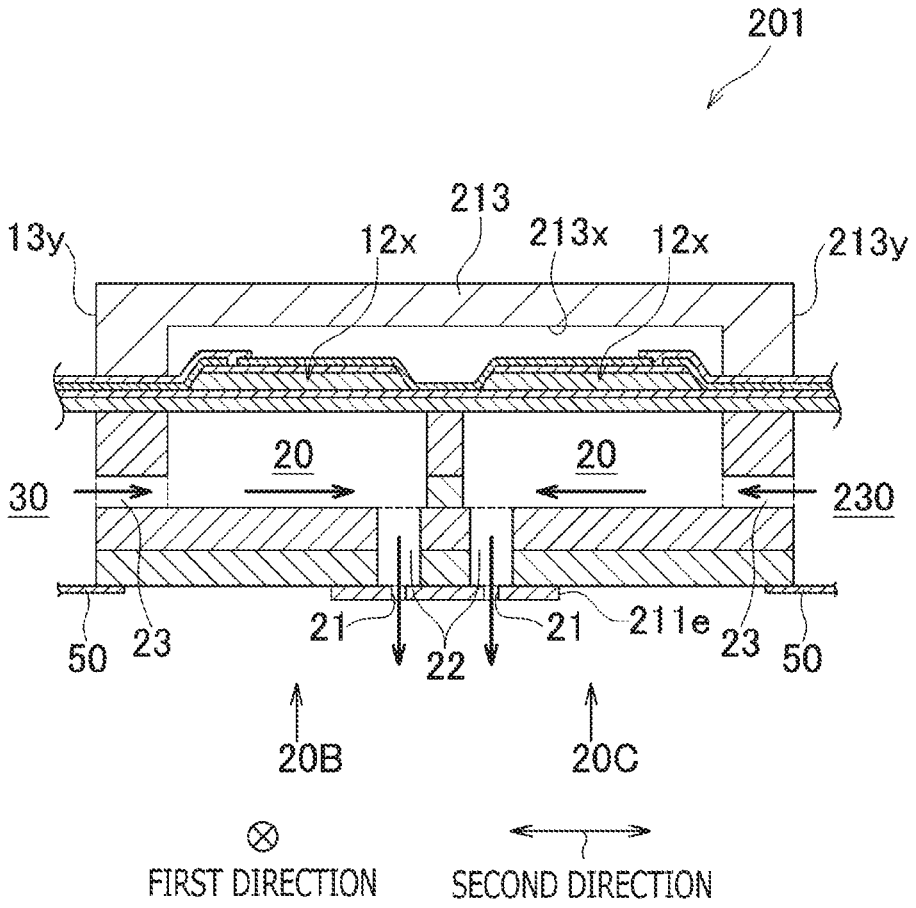
FIG. 7 is a partial cross-sectional view of the head 201 according to the second embodiment of the present disclosure viewed along a line VII-VII shown in FIG. 6.

While in the first embodiment the head 1 has two (2) pressure chamber groups 20A, 20B and the single common flow path 30 that communicates with the plurality of pressure chambers 20 belonging to the pressure chamber groups 20A, 20B (see FIG. 2), in the second embodiment, the head 201 has four (4) pressure chamber groups 20A-20D, the common flow path 30 that communicates with the plurality of pressure chambers 20 belonging to two (2) of the pressure chamber groups 20A, 20B, and another common flow path 230 that communicates with the plurality of pressure chambers belonging to the other two (2) of the pressure chamber groups 20C, 20D (see FIG. 6).

The pressure chamber group 20C includes a plurality of pressure chambers 20 that are arranged in line along the first direction to be evenly spaced apart from one another. The pressure chamber group 20D includes a plurality of pressure chambers 20 that are arranged in line along the first direction to be evenly spaced apart from one another. Between the first pressure chamber group 20A and the third pressure chamber group 20C in the second direction, arranged is the second pressure chamber group 20B. Between the first pressure chamber group 20A and the fourth pressure chamber group 20D in the second direction, arranged are the second pressure chamber group 20B and the third pressure chamber group 20C.

The common flow path 230, similarly to the common flow path 30, extends in the first direction and, although not shown in the drawings, has the supplying opening 30*x* on one end in the first direction and the returning opening 30*y* and the air-outlet opening 30*z* on the other end in the first direction (see also FIG. 4). The common flow path 230 is, as shown in FIG. 6, arranged between the third pressure chamber group 20C and the fourth pressure chamber group 20D in the second direction.

A protector board 213 (see FIG. 7) has two (2) raised portions 13*x* (not shown in FIG. 7 but see FIG. 3), one (1) raised portion 213*x*, and two (2) through holes 13*y*, 213*y*. One and the other of the raised portions 13*x* are provided to the first pressure chamber group 20A and the fourth pressure chamber group 20D, respectively. The raised portion 213*x* is provided commonly to the second pressure chamber group 20B and the third pressure chamber group 20C. In the raised portion 213*x*, a plurality of actuators 12*x* corresponding to the second pressure chamber group 20B and the third pressure chamber group 20C are accommodated. In the through hole 13*y*, an end part of the wiring board 90 (see FIG. 3) corresponding to the first pressure chamber group 20A and the second pressure chamber group 20B is arranged. In the through hole 213*y*, an end part of the wiring board 90 (see FIG. 3) corresponding to the third pressure chamber group 20C and the fourth pressure chamber group 20D is arranged.

In a single piece of nozzle plate 211*e* (see FIG. 7), formed are a plurality of nozzles 21 communicating with the pressure chambers 20 that belong to the second pressure chamber group 20B and a plurality of nozzles 21 communicating with the pressure chambers that belong to the third pressure chamber group 20C. The nozzle plate 211*e* is a substantially rectangular plate and is located between the damper sheet 50 arranged on the lower side of the common flow path 30 and the damper sheet 50 arranged on a lower side of the common flow path 230 in the second direction. The nozzles 21 communicating with the pressure chambers 20 that belong to the first pressure chamber group 20A and the nozzles 21 communicating with the pressure chambers 20 that belong to the fourth pressure chamber group 20D are formed in two (2) separate nozzle plates that are different from the nozzle plate 211*e*.

In this arrangement, compared to an arrangement, in which the nozzles 21 communicating with the pressure chambers 20 that belong to the second pressure chamber group 20B and the nozzles 21 communicating with the pressure chambers 20 that belong to the third pressure chamber group 20C are formed in two (2) separate nozzle plates, an operation to adhere the single nozzle plate 211*e* at the bottom of the head 201 may be less complicated, a number of adhering operations may be reduced so that the head 201 may be assembled more easily.

Moreover, in the first embodiment the linking flow path 23 and the connecting flow path 22 that correspond to the same pressure chamber 20 are located at positions different from each other in the first direction and in proximity to each other in the second direction, and each pressure chamber 20 has the partition wall 10 between the linking flow path 23 and the connecting flow path 22 in the first direction (see FIG. 2). In this regard, in the second embodiment, the linking flow path 23 and the connecting flow path 22 that correspond to the same pressure chamber 20 are located at the same position in the first direction but at positions spaced apart from each other in the second direction, and no partition wall 10 is arranged in the pressure chamber 20 (see FIG. 6).

In this arrangement, the ink flowing from the linking flow path 23 into the pressure chamber 20 may flow from the one end to the other end in the second direction in the pressure chamber 20 without making a U-turn to flow into the connecting flow path 22. Therefore, the ink may be supplied rather directly to the connecting flow path 22, and the ink may be discharged from the nozzle 21 smoothly.

MORE EXAMPLES

Although examples of carrying out the invention have been described, those skilled in the art will appreciate that there are numerous variations and permutations of the liquid discharging head that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, the second direction may not necessarily be orthogonal to the first direction as long as the second direction intersects with the first direction.

For another example, the path of the liquid to flow through the returning opening and the path of the liquid to flow through the air-outlet opening may not necessarily be switched by the switching valve 7*v* (see FIG. 4). Alternatively, for example, a flow path to connect the subsidiary tank with the returning opening and a flow path to connect the subsidiary tank with the air-outlet opening may each have an open/close valve.

For another example, the supplying opening and the air-outlet opening to be arranged at the upper end positions in the common flow path may not necessarily be arranged on the upward face of the common flow path but may be, for example, arranged in upper positions on a lateral face of the common flow path.

For another example, the supplying opening may not necessarily be arranged at the upper end position in the common flow path but may be arranged at any vertically different position, such as a vertically central position in the common flow path.

For another example, the air-outlet opening and the switching valve may be omitted.

For another example, the returning opening may not necessarily be arranged on the lower end of the common flow path but may be arranged at any vertically different position, such as a vertically central position in the common flow path.

For another example, the returning opening may be arranged on the upward face of the common flow path, and the returning flow path may be omitted.

For another example, in a head with a plurality of common flow paths, the positions of the supplying opening and the returning opening in the first direction may not necessarily be the same but may be different between the plurality of common flow paths. In particular, in the head 201 described in the second embodiment, the supplying opening in the common flow path 30 may be arranged at one end in the first direction, e.g., a lower end in FIG. 6, and the supplying opening in the common flow path 230 may be arranged on the other end in the first direction, e.g., an upper end in FIG. 6. In this arrangement, the ink in the common flow path 30 and the ink in the common flow path 230 may flow in directions opposite to each other.

For another example, the damper sheet may not necessarily be arranged on the lower side of the common flow path but may be arranged on the lateral or upper side of the common flow path. For another example, further, the damper sheet may be arranged on a side where the supplying opening, the returning opening, or the air-outlet opening is arranged.

For another example, in the first embodiment, two (2) pieces of nozzle plates 11*e*1 11*e*2 may be replaced with a single rectangular frame-shaped plate, in which a through hole to be covered by the damper sheet 50 is formed at a center, with all of the plurality of nozzles 21 being formed therein.

For another example, the linking flow paths may not necessarily be linked to the pressure chambers at lower ends of the pressure chambers but may be linked at any vertical position, such as a vertically central position in the pressure chambers.

For another example, the linking flow paths may not necessarily extend in the second direction but may extend in the third direction or a direction that extends orthogonally to the third direction and intersects with both the first direction and the second direction.

For another example, lengths of each partition wall in the second direction and the third direction may not necessarily be limited to those described in the first embodiment but may be modified alternatively or optionally. For example, the partition wall may be arranged merely in an area that overlaps the connecting flow path in the first direction. For another example, the partition wall may be arranged at a central position in the pressure chamber in the first direction and in the second direction. For another example, in the first embodiment, the partition walls may be omitted.

For another example, the connecting flow paths may be omitted, and the nozzles may be arranged directly below the pressure chambers.

For another example, the protector board may be omitted. If the protector board is omitted, a member different from the protector board may define parts of the supplying paths 31 and the returning paths 32, and the air-outlet paths 33 (see FIG. 4).

Each of the pressure chamber groups may not necessarily be composed of a single array of pressure chambers but may be composed of a plurality of arrays of pressure chambers. In this arrangement, a common flow path may be arranged between the plurality of arrays of pressure chambers in the first pressure chamber group and the plurality of arrays of pressure chambers in the second pressure chamber group.

For another example, a quantity of nozzle(s) to communicate with each pressure chamber may not necessarily be limited to one (1) but may be two (2) or more. For another example, a quantity of pressure chamber(s) provided to each nozzle may not necessarily be limited to one (1), but two (2) or more pressure chambers may be provided to each of the nozzles. In other words, the nozzles and the pressure chambers may not necessarily be in one-to-one correspondence as long as at least one nozzle is provided to at least one pressure chamber.

For another example, the actuators may not necessarily be limited to the device to piezoelectrically pressurize the pressure chambers but may be a device that may pressurize the pressure chambers in a different style, such as a thermally pressurizing device with a heating element or an electrostatically pressurizing device using electrostatic force.

For another example, the liquid discharging head may not necessarily be limited to the line-printing head but may be a serially discharging head that may discharge the liquid at a discharging target through a nozzle while the head moves in a scanning direction parallel to a width of the target.

For another example, the discharging target may not necessarily be limited to a sheet of paper but may be, for example, a piece of fabric or a board.

For another example, the liquid to be discharged through the nozzle(s) may not necessarily be limited to ink but may be any other liquid. For example, a processing agent to agglutinate or precipitate components in the ink may be discharged.

For another example, the head described in the present disclosure may be applicable not only to a printer but also to, for example, a facsimile machine, a copier, and a multifunction peripheral. Further, the heads described in the present disclosure may be applicable to a liquid discharging apparatus that may be usable in a purpose different from image recording, such as a liquid discharging apparatus to discharge electrically conductive liquid form a conductive pattern on a board.

What is claimed is:

1. A liquid discharging head, comprising:

a first pressure chamber group having a plurality of pressure chambers arrayed in a first direction;

a second pressure chamber group having a plurality of pressure chambers arrayed in the first direction, the second pressure chamber group aligning with the first pressure chamber group along a second direction intersecting with the first direction; and a common flow path extending in the first direction, the common flow path communicating with each of the plurality of pressure chambers belonging to the first pressure chamber group and the plurality of pressure chambers belonging to the second pressure chamber group, the common flow path having a supplying opening at one end thereof in the first direction and a returning opening at the other end thereof in the first direction, the common flow path being located between the first pressure chamber group and the second pressure chamber group in the second direction.

2. The liquid discharging head according to claim 1, wherein the returning opening is arranged at a lower end of the common flow path, and wherein the liquid discharging head further comprises:

an air-outlet opening arranged at an upper end of the common flow path; and a valve configured to switch paths of the liquid between a path to flow through the returning opening and a path to flow through the air-outlet opening.

3. The liquid discharging head according to claim 2, further comprising a returning flow path connected with the returning opening and extending upward.

4. The liquid discharging head according to claim 1, wherein the supplying opening is arranged at an upper end of the common flow path.

5. The liquid discharging head according to claim 1, wherein the common flow path is defined partly by a damper sheet.

6. The liquid discharging head according to claim 5, wherein a face of the common flow path defined by the damper sheet differs from a face of the common flow path, on which the supplying opening is arranged, and from a face of the common flow path, on which the returning opening is arranged.

7. The liquid discharging head according to claim 5, further comprising:

a first nozzle plate, in which a plurality of nozzles are formed, the plurality of nozzles in the first nozzle plate each communicating with each of the plurality of pressure chambers belonging to the first pressure chamber group; and a second nozzle plate, in which a plurality of nozzles are formed, the plurality of nozzles in the second nozzle plate each communicating with each of the plurality of pressure chambers belonging to the second pressure chamber group, the second nozzle plate being separated from the first nozzle plate and being arranged to interpose the damper sheet between the second nozzle plate and the first nozzle plate.

8. The liquid discharging head according to claim 1, further comprising:

a third pressure chamber group having a plurality of pressure chambers arrayed in the first direction, the third pressure chamber group being arranged to interpose the second pressure chamber group between the third pressure chamber group and the first pressure chamber group;

a fourth pressure chamber group having a plurality of pressure chambers arrayed in the first direction, the fourth pressure chamber group being arranged to interpose the second pressure chamber group and the third pressure chamber group between the fourth pressure chamber group and the first pressure chamber group;

another common flow path extending in the first direction, the another common flow path communicating with each of the plurality of pressure chambers belonging to the third pressure chamber group and the plurality of pressure chambers belonging to the fourth pressure chamber group, the another common flow path having a supplying opening at one end thereof in the first direction and a returning opening at the other end thereof in the first direction, the another common flow path being located between the third pressure chamber group and the fourth pressure chamber group in the second direction; and a nozzle plate being a single plate, in which a plurality of nozzles are formed, the plurality of nozzles including nozzles that each communicate with each of the plurality of pressure chambers in the third pressure chamber group and nozzles that each communicate with each of the plurality of pressure chambers in the fourth pressure chamber group.

9. The liquid discharging head according to claim 1, further comprising a plurality of linking flow paths each linking each corresponding one of the plurality of pressure chambers with the common flow path, each of the plurality of linking flow paths being arranged in a range of the corresponding one of the plurality of pressure chambers in a third direction, the third direction intersecting orthogonally with the first direction and with the second direction.

10. The liquid discharging head according to claim 9, wherein each of the plurality of linking flow paths is linked to a lower end of the corresponding one of the plurality of pressure chambers.

11. The liquid discharging head according to claim 9, further comprising:

a plurality of nozzles each communicating with each corresponding one of the plurality of pressure chambers; and a plurality of connecting flow paths each extending in the third direction and connecting each of the plurality of pressure chambers with each of the plurality of nozzles, wherein each of the plurality of connecting flow paths is located at a position different in the first direction from each corresponding one of the linking flow paths corresponding to a same one of the plurality of pressure chambers and at a position in proximity in the second direction to the corresponding one of the linking flow paths.

12. The liquid discharging head according to claim 11, further comprising a plurality of partition walls each arranged in each of the plurality of pressure chambers, each of the plurality of partition walls being located between one of the plurality of linking flow paths and one of the plurality of connecting paths corresponding to the same one of the plurality of pressure chambers.

13. The liquid discharging head according to claim 9, further comprising:

a plurality of nozzles each communicating with each of the plurality of pressure chambers; and a plurality of connecting flow paths each extending in the third direction and connecting each of the plurality of pressure chambers with each of the plurality of nozzles, wherein each of the plurality of connecting flow paths is located at a same position in the first direction with each corresponding one of the linking flow paths corresponding to a same one of the plurality of pressure chambers and at a position separated in the second direction from the corresponding one of the linking flow paths.

14. The liquid discharging head according to claim 1, further comprising:

a flow path board, in which the plurality of pressure chambers and the common flow path are formed;

an actuator board fixed to the flow path board, the actuator board having a plurality of actuators each arranged to overlap each of the plurality of pressure chambers in a third direction, the third direction intersecting orthogonally with the first direction and with the second direction; and a wiring board connected electrically with each of the plurality of actuators, the wiring board being fixed to the actuator board in an area overlapping the common flow path in the third direction.

* * * * *